United States Patent [19]

Jones

[11] 3,961,849

[45] June 8, 1976

[54] ELECTROSTATIC PRINTING MACHINE

[75] Inventor: Hugh L. Jones, Rochester, N.Y.

[73] Assignee: Xerox Corporation, Stamford, Conn.

[22] Filed: Apr. 12, 1974

[21] Appl. No.: 460,316

Related U.S. Application Data

[63] Continuation of Ser. No. 97,572, Dec. 14, 1970, abandoned.

[52] U.S. Cl. ..... 355/11; 355/16

[51] Int. Cl.[2] ..... G03G 15/22

[58] Field of Search ..... 355/16, 3 R, 3 DD, 11, 355/3 BE

[56] References Cited

UNITED STATES PATENTS

| | | | |
|---|---|---|---|
| 3,241,466 | 3/1966 | Clark | 355/3 |
| 3,572,922 | 3/1971 | Olden | 355/3 DD |
| 3,612,677 | 10/1971 | Langdon et al. | 355/4 |
| 3,661,452 | 5/1972 | Hewes et al. | 355/3 |

OTHER PUBLICATIONS

"An Electrographic Printer With Asynchronous Image Belt", Hider et al., IBM Technical Disclosure Bulletin: vol. 9, No. 11, Apr. 1967, pp. 1526–1527.

*Primary Examiner*—L. T. Hix
*Assistant Examiner*—Kenneth C. Hutchison

[57] ABSTRACT

An arrangement of processing actions in an electrostatic printing machine of the type employing an endless photoconductive belt. The actions are arranged such that the exposure station for the machine occupies an entire belt run, a second run is utilized for magnetic brush development, and a third run is utilized for charging the belt prior to exposure and for cleaning the belt after each transfer of a developed image.

2 Claims, 4 Drawing Figures

INVENTOR.
HUGH L. JONES

BY B. A. Chiama

ELECTROSTATIC PRINTING MACHINE

This is a continuation of application Ser. No. 97,572, filed Dec. 14, 1970, now abandoned.

This invention relates to electrostatic printing machines, and in particular, to a unique configuration of an endless photoreceptor belt and an arrangement of processing stations relative thereto.

Electrostatic printing machines of the endless belt type employ various processing stations which will uniformly charge, expose, develop, transfer, clean, etc. during any cycle of copying. In the configuration of these machines, it becomes very important that there be a proper arrangement of the processing stations in order to maximize the efficiency of one or more of these stations or to accommodate the structure of one or more of the stations which are relatively large or which may require a specific orientation. In order to accommodate large size processing structure or because of orientation such as the gravity requirements for cascade development, maximum efficiency is compromised and the complete electrostatic machine is not operating in its entirety by the most efficient means possible.

Therefore, the principal object of the present invention is to improve electrostatic printing machines of the type employing electrostatic photoreceptor belts.

Another object of the present invention is to arrange electrostatic processing stations relative to an endless belt photoreceptor so as to effect maximum efficiency in the operation of the machine especially for high speed reproduction.

The foregoing objects are attained by an arrangement of processing stations relative to an endless electrostatic photoreceptor belt wherein a magnetic brush developing apparatus having a plurality of magnetic brushes in arranged to be applied to the photoreceptor belt at a flat run thereof and wherein transfer to individual sheets of paper of developed images is accomplished at the periphery of one of the rollers which supports the belt for endless movement. Exposure of the belt to imaging light rays of an original to be copied is effected on another flat run of the belt, and a third run of the belt is utilized for purposes of cleaning the belt of remnants of the developing material utilized during development of the latent image and all traces of any latent images remaining on the belt after transfer of a developed image.

It will become apparent after reading the following specification in conjunction with the drawings that in the present invention wherein an endless electrostatic photoreceptor belt is utilized, a proper selection of processing structures have been chosen and positioned in such an arrangement as to effect the most efficient operation of the machine, especially for high speed production.

Figure 1:
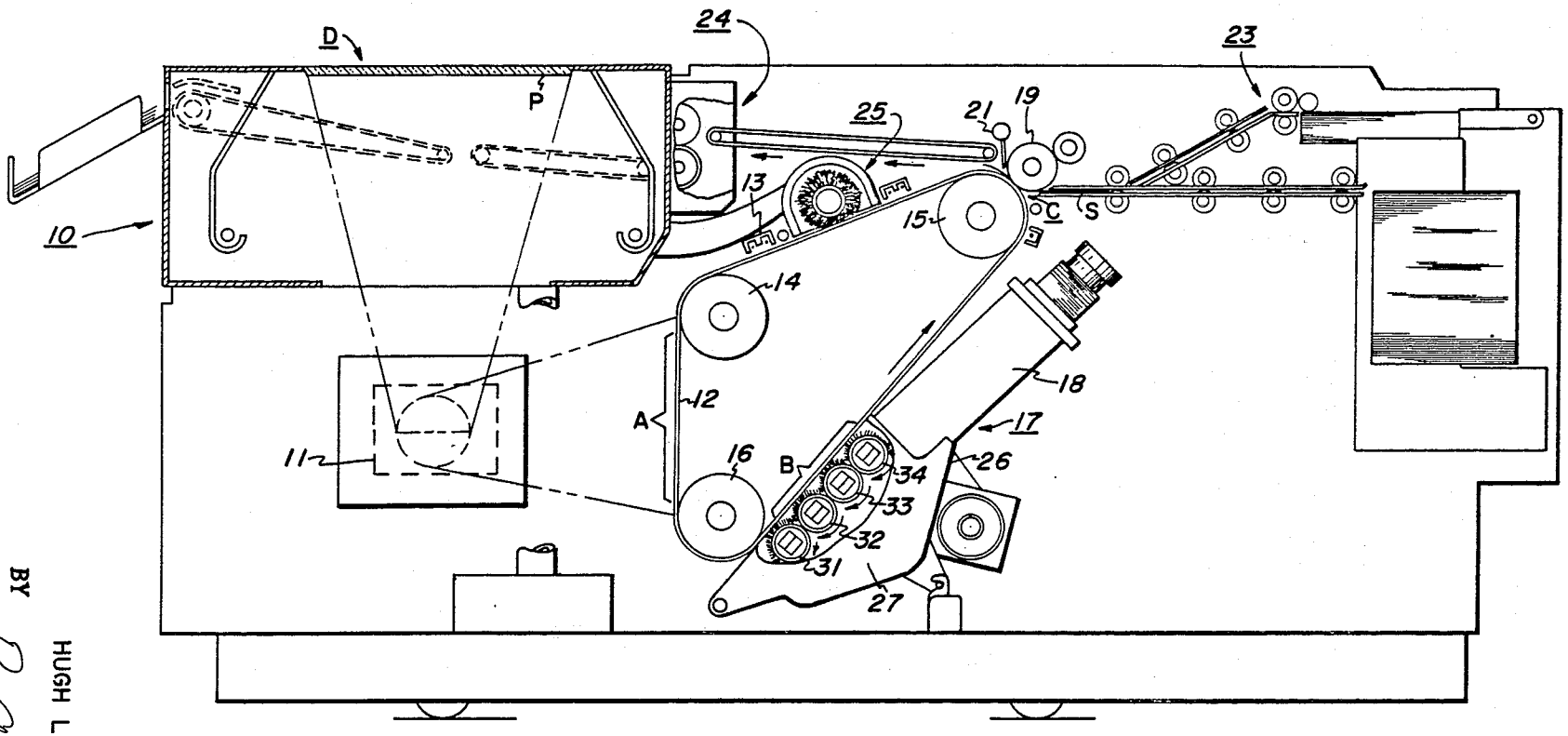
FIG. 1 is a schematic sectional view of an electrostatic reproduction machine embodying the principles of the invention.

For a general understanding of an electrostatic processing system in which the invention may be incorporated, reference is had to FIG. 1 in which various components of a system are schematically illustrated. As in all electrostatic systems such as a xerographic machine of the type illustrated, a light image of an original to be reproduced is projected onto the sensitized surface of a xerographic plate to form an electrostatic latent image thereon. Thereafter, the latent image is developed with an oppositely charged developing material comprising carrier beads and smaller toner particles triboelectrically adhering thereto to form a xerographic powder image, corresponding to the latent image on the plate surface. The powder image is then electrostatically transferred to a support surface to which it may be fixed by a fusing device whereby the powder image is caused permanently to adhere to the support surface.

The electrostatically attractable developing material commonly used in magnetic brush developing apparatus comprises a pigmented resinous powder referred to here as "toner" and a "carrier" of larger granular beads formed with steel cores coated with a material removed in the triboelectric series from the toner so that a triboelectric charge is generated between the toner powder and the granular carrier. The magnetizable carrier also provides mechanical control for the formation of brush bristles by virtue of magnetic fields so that the toner can be readily handled and brought into contact with the exposed xerographic surface. The toner is then attracted to the electrostatic latent image from the carrier bristles to produce a visible powder image on an insulating surface.

In the illustrated machine, an original D to be copied is placed upon a transparent support platen P fixedly arranged in an illumination assembly generally indicated by the reference numeral 10. While upon the platen, an illumination system flashes light rays upon the original thereby producing image rays corresponding to the informational areas on the original. The image rays are projected by means of an optical system 11 to an exposure station A for exposing the photosensitive surface of a moving xerographic plate in the form of a flexible photoconductive belt 12. In moving in the direction indicated by the arrow, prior to reaching the exposure station A, that portion of the belt being exposed would have been uniformly charged by a corona device 13 located at a belt run extending between belt supporting rollers 14 and 15. The exposure station extends between the roller 14 and a third support roller 16, and the belt run between these rollers is encompassed entirely by the exposure station for minimizing the space needed for the belt and its supporting rollers.

The exposure of the belt surface to the light image discharges the photoconductive layer in the areas struck by light, whereby there remains on the belt a latent electrostatic image in image configuration corresponding to the light image projected from the original on the supporting platen. As the belt surface continues its movement, the electrostatic image passes around the roller 16 and through a developing station B located at a third run of the belt in which there is positioned a developing apparatus generally indicated by the reference numeral 17. Suitable means (not shown) such as, vacuum panels or tensioning means may be utilized for maintaining the belt flat in all three belt runs, and additionally, the belt run related to the development zone B is maintained at an inclined plane. The developing apparatus 17 comprises a plurality of magnetic brushes which carry developing material to the adjacent surface of the upwardly moving inclined photoconductive belt 12 in order to provide development of the electrostatic image.

As the developing material is applied to the xerographic belt, toner particles in the development material are attracted electrostatically to the belt surface to form powder images. As toner powder images are formed additional toner particles are supplied to the developing material in proportion to the amount of toner deposited on the belt during xerographic processing. For this purpose, a toner dispenser generally indicated by reference numeral 18 is used to accurately meter toner, upon demand, to the developer material in the developing apparatus 17.

The developed electrostatic image is transported by the belt 12 to a transfer station C located at a point of tangency on the belt as it moves around the roller 15 whereat a sheet of copy paper is moved at a speed in synchronism with the moving belt in order to accomplish transfer of the developer image. There is provided at this station a transfer roller 19 which is arranged on the frame of the machine for contacting the non-transfer side of each sheet of copy paper as the same is brought into transfer engagement with the belt 12. The roller 19 is electrically biased with sufficient voltage so that a developed image on the belt 12 may be electrostatically transferred to the adjacent side of a sheet of paper S as the same is brought into contact therewith, and also for tacking the same on the roller 19. A stripping finger or air puffing device 21 utilized for stripping the sheet from the roller is provided to permit pick-up and continued movement of the sheet by a vacuum conveying system 22. In tacking on the roller 19, each sheet of paper travels only a short distance before being stripped therefrom by the stripper 21. Devices such as gripper bars and release elements mounted on the roller 19 may be utilized instead of the stripper 21 for gripping the leading edge of each sheet of copy paper to ensure proper positioning thereon and to effect the release of a copy sheet at a precise time so as to strip the same for pick-up by a conveying system. The timing of the release of each edge relative to the sheet separation from the supply stack of sheets may be for the same period of time.

There is also provided a suitable sheet transport mechanism adapted to transport sheets of paper seriatim from a paper handling mechanism generally indicated by the reference numeral 23 to the developed image on the belt as the same is carried around the roller 15. A programming device operatively connected to the mechanism 23, the stripper device 21 and the illumination device for producing an electrostatic latent image on the belt 12 is effective to present a developed image at the transfer station C in timed sequences with the arrival of a sheet of paper and being coordinated with the activation of the stripper 21 at the precise time that these elements are to function for their intended purpose.

After the sheet is stripped from the belt 12, it is conveyed by the conveying system 22 into a fuser assembly generally indicated by the reference numeral 24 wherein the developed and transferred xerographic powder image on the sheet material is permanently affixed thereto. After fusing, the finished copy is discharged from the apparatus at a suitable point for collection externally of the apparatus. The remaining toner particles remaining as residue on the developed images, background particles and those particles otherwise not transferred are carried by the belt 12 to a cleaning apparatus 25 positioned on the run of the belt between the rollers 14, 15 adjacent the charging device 13. The cleaning device comprises a rotating brush, a corotron for neutralizing charges remaining on the particles and discharge lamp for discharging any remaining electrostatic charges on the belt. It will be appreciated that the run of the belt adjacent the cleaning device is at an incline angle relative to the horizontal as this run leaves the uppermost roller 15 where a developed image is transferred. Such an arrangement maintains the relatively straight line of copy sheet movement which operatively cooperates with the printing belt 12 at its highest point.

From the foregoing, it will be apparent that the configuration and positioning of the processing devices for electrostatic reproductions nd the inclined angles of two of the runs are such as to utilize fully all three runs of the photoconductive belt 12 so as to minimize its size as well as to optimize efficiency and the utilization of machine space. The arrangement also results in a machine which has a height that is ideal for operator that is, waist high, especially in the provision of a paper path of movement above the image processing apparatus. In this manner paper jams can be attended to easily, without dismantling or involvement with other apparatus in the machine, and without having to resort to activities in the vicinity of the floor supporting the machine or the lower regions thereof.

Figure 2:
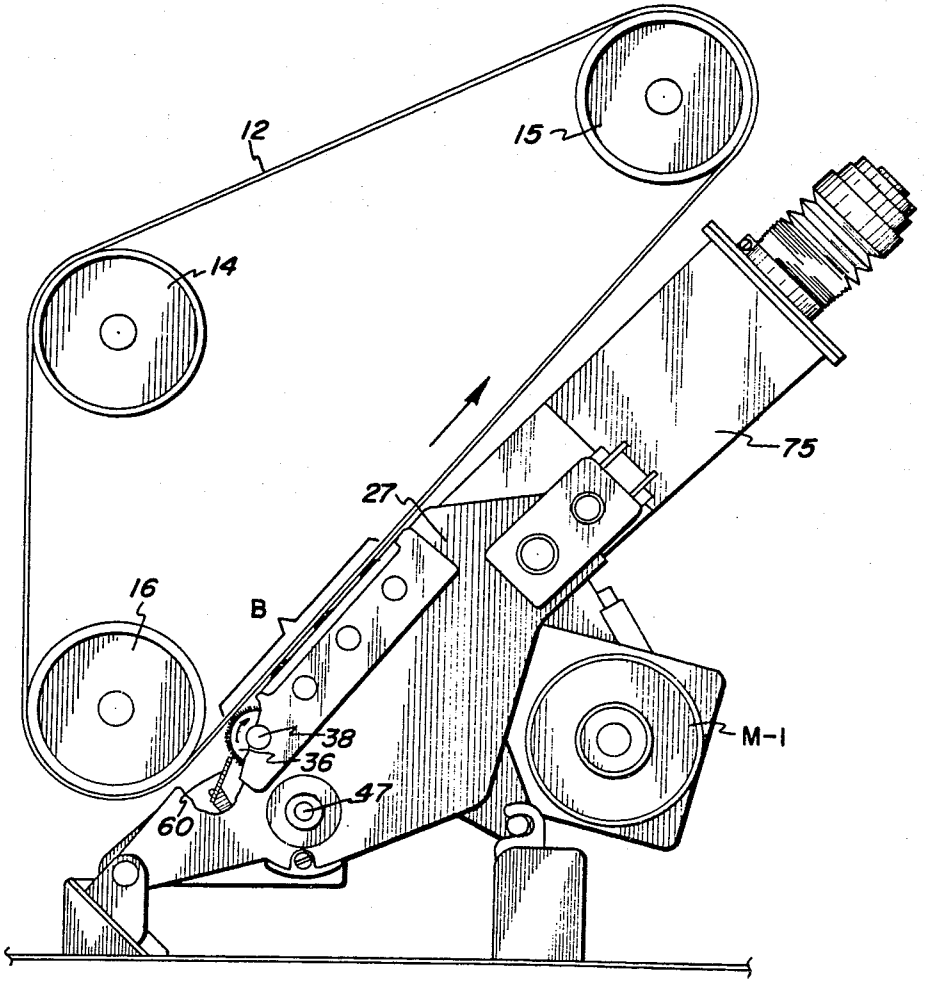
FIG. 2 is an enlarged elevational view of a magnetic brush developing apparatus utilized in the machine shown in FIG. 1, with parts broken away.
Figure 3:
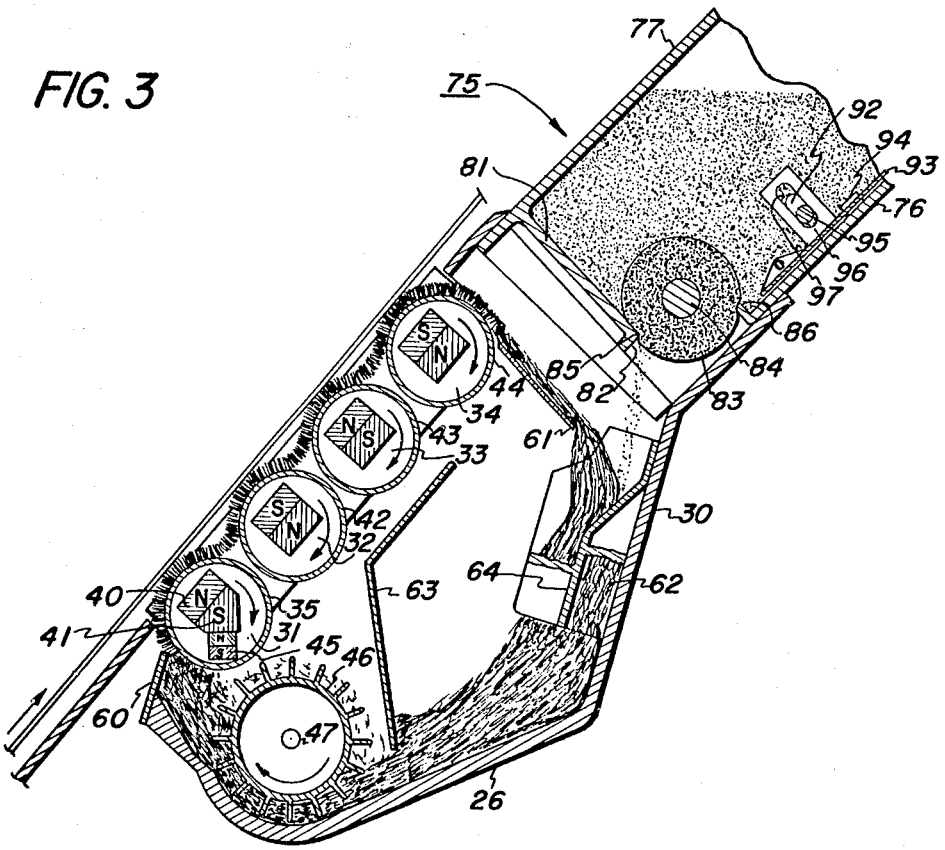
FIG. 3 is a partial sectional view of the magnetic brush developing system showing the recirculation flow path of developing material.

As shown in FIGS. 2 and 3, the developing apparatus comprises a housing 26 having a generally rectangular cross section and a length extending beyond the width of the belt 12. The housing 26 is substantially closed except for an opening adjacent the photoconductive belt 12 whereat development of the latent image is effected. This housing serves as a container, closed at its ends, by end walls 27 and 28 and supporting an inclined bottom wall 30 for containing developing material comprising carrier beads from magnetizable material and colored electrostatic toner particles which adhere electrostatically in great numbers to the carrier beads.

Mounted for rotation within the developer housing are four magnetic brushes 31, 32, 33, and 34 positioned with their axes in parallel and below the selenium belt 12. The magnetic brush 31, comprising outer cylinder 35, made of non-magnetizable material and extending almost the length of the housing 26, is mounted for rotation by and between the end walls 27, 28.

One end of the cylinder 35 is closed by a cap 36 which supports a drive shaft 38 in axial alignment with the cylinder and is mounted in suitable bearings on the end plate wall 27. The other end of the cylinder is similarly supported by the wall 28. Within the cylinder 35 there is positioned elongated bar magnets 40, 41 extending nearly the full length of the cylinder and being mounted therein by means of suitable shafts (not shown) rotatably supported in the end caps for the cylinder. These shafts on the magnets 40, 41 may be adapted to be rotated by an external control device as will be described hereinafter for rotating the bar magnets. In operation during a development cycle, the brush cylinder 35 is rotated by way of the drive shaft 38 and the magnets 40, 41 remain stationary.

The second, third and fourth magnetic brushes 32, 33 and 34 each comprise a cylinder 42, 43, 44 respectively, end caps for the respective cylinders, complement bar magnets and rotatably supporting shafts therefor. Since each of the brushes 32, 33, 34 is similar to the structure of the brush 31, further details are not necessary to describe these brushes. Their only distinction lies in the relative orientation of magnet polarities (see FIG. 3 for preferred arrangement) and the inclusion of a pick-up magnetic device 45 for the first brush 31. The pick-up device 45 includes bar magnets supported by the magnets 40, 41 for the magnetic brush 31 for transporting developing material from the lower sump portion of the housing 26 and to the adjacent periphery of the cylinder 35.

As shown in FIG. 3, the peripheral walls of the brush cylinder 35 and those for the other brushes are relatively close to each other. During a development cycle when all cylinders are rotating in unison in the same direction and with their respective magnetic bars held stationary, the brush bristles produced by the influence of the magnetic field emanating from the bar magnets acting upon the magnetizable carrier beads in the developing material will form on the upper region of the cylinder 35 between this cylinder and the undersurface of the selenium belt 12. Bristles remain formed during the developing cycle, being initiated by the influence of the pick-up device 45 and maintained, during rotation of the cylinder 35 produced by the magnetic field of the magnets 40, 41. When bristles are moved out of the influence of the magnets 40, 41 beyond the closest distance between the belt 12 and the cylinder 35, they maintain formation by the influence of the magnetic field for the magnets associated with the brush 32, which influence is stronger at this point than the diminished strength of the magnetic field attributed to the magnets for the brush 31. The developing material is carried during rotation of the cylinder 42 until they in turn reach the stronger influence of the magnetic brush 33, which effects the continued formation of bristles and movement of the bristles until the influence of the last brush 34 is stronger than the diminishing influence of the brush 33. After passing the last brush 34, the cylinder 44 thereof transports the remaining developing material around the same from which they will be directed eventually to the sump of the housing 36 by gravity.

During movement of the carrier beads and toner through the development zone B, the magnetic bristles and, therefore, the development material, is in the form of a "magnetic blanket" extending continuously over all of the brushes 31–34 for the entire width of the development zone B wherein the material is disposed or available to some degree for developing purposes. Control means, not shown, may be operatively connected to the shafts associated with each of the bar magnet pairs 40, 41 for each of the magnetic brushes for rotating the pairs in unison in order to terminate the formation of bristles on each of the brushes. In this manner, the magnetic blanket over all of the brushes may be quickly eliminated during the operating program for the reproduction machine. Upon a restart of the machine, the control means may be set to be activated as the machine is placed in standby condition wherein all magnet pairs are oriented to operative positions. It will be apparent that the width of the development zone B is larger than the sum of the individual development zones for each of the magnetic brushes.

Further details regarding the formation and effect of the magnetic blanket are described in the copending application Ser. No. 830,285 assigned to the same assignee as the present application and now U.S. Pat. No. 3,640,248, issued Feb. 8, 1972.

Also mounted within the development housing 26 and below the magnetic brush 31 is a paddle wheel impeller 46 having a plurality of blades radially extending therefrom and having its ends rotatably mounted in the end walls 27, 28 by means of a drive shaft 47. During a development cycle, the impeller 46 is rotated in the direction shown by the arrow in FIG. 3 and serves to transport development material toward the pick-up device adjacent the lower surface of the magnetic brush 31 independent of the state of levelness and the amount of carrier beads in the system. The development material in this vicinity is picked up by the pick-up magnet which commences the formation of bristles on the cylinder 35. As this cylinder rotates, the newly formed bristles come under the influence of the magnets 40, 41 and the magnetic blanket for the assembly 17 will be initiated.

Figure 4:
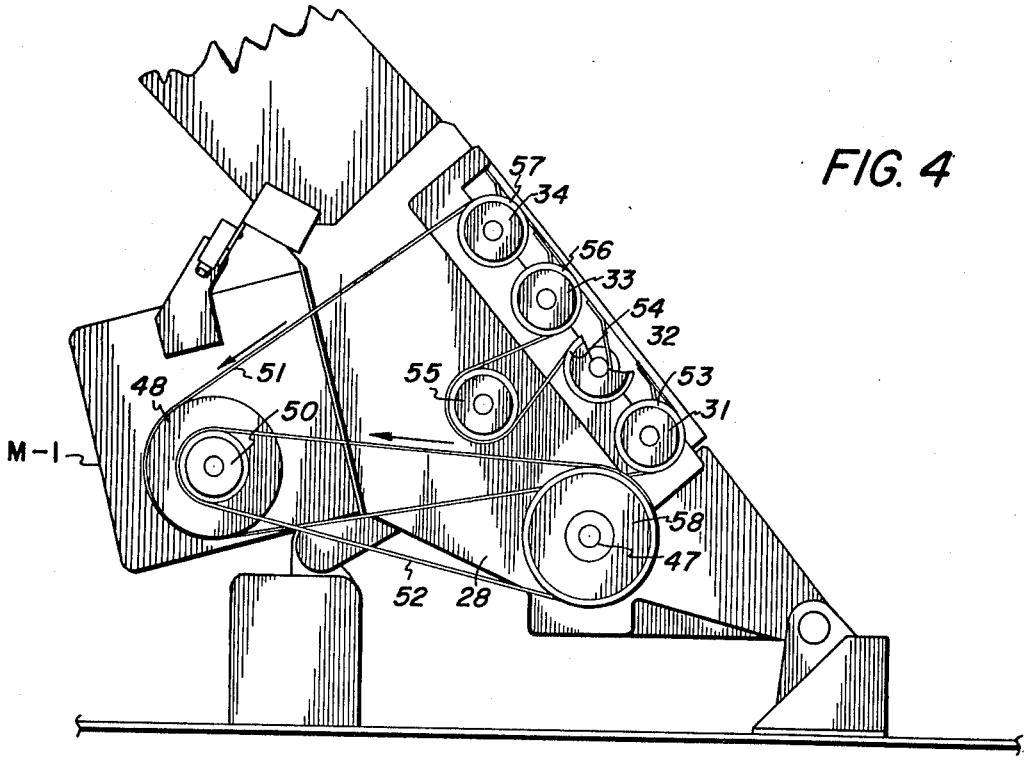
FIG. 4 is an elevational view of another side of the housing shown in FIG. 3 and showing the drive mechanism for the magnetic brushes.

The rotational motion for all of the rotary components of the developing apparatus 17, as illustrated in FIG. 4, is derived by a motor M-1 and a drive system comprising a pulley 48 secured to the shaft of the motor, a smaller pulley 50 also secured to the shaft, and timing belts 51, 52 for connecting the pulleys 48, 50 respectively, to the rotary components. Specifically, the belt 51 is drivingly engageable with suitable pulleys 53, 54 mounted on the drive shafts for each of the magnetic brush cylinders 31, 32 respectively, an idler pulley 55 and pulleys 56, 57 secured to the drive shafts for the magnetic brush cylinders 33, 32 respectively. With this arrangement, the four magnetic brush cylinders rotate with the same peripheral speeds, in the same direction and in a direction which moves the magnetic blanket comprising magnetic brush bristles upwardly in an inclined plane arranged at the same angle as the angle of the plane which the belt 12 assumes in the development run. The timing belt 52 connects the drive pulley 50 with a driven pulley 58 secured to the shaft 47 for the impeller 46 thereby assuring that the impeller and the magnetic brush cylinders move in unison. The relative speed of the impeller 46 is slightly less than the peripheral speeds of the magnetic brush cylinders but incorporates a surface capacity which provides an excess of development material being transported by the impeller which cannot be picked up by the pick-up device 45 will be carried around the impeller and back into the sump of housing 26.

In order to optimize the length of the bristles during the formation of the magnetic blanket upon the four cylinders, the cylinder 35 has associated therewith a trimming blade 60 secured to the end walls 27, 28 of the housing 26. This blade extends radially toward the cylinder 35 and being spaced from the periphery thereof a short distance equal to the desired length of the bristles to be formed on each of the magnetic brush 31. The blade also smoothes the developing material and contains the powder cloud in the housing 26.

The depleted developing material which is carried beyond the magnetic brush 34 or the last brush in the chain of magnetic brushes that comprise the developing device, is conveyed back into the housing 26 in order to be reused for development purposes. As this material is moved by the cylinder 44, away from the development zone B before being directed back into the sump of the housing 26, it is directed by a longitudinal planar baffle plate 61 secured at its ends on the end walls 27, 28 for the developer housing 26 to the upper end of a cross-mixing baffle generally indicated by the numeral 62. Another baffle plate 63 mounted within the housing 26 controls the movement of the development material leaving the cross-mixing baffle 62 into working engagement with the paddle wheel 46 for presenting the development material to the pick-up magnet 45.

While the invention has been described with reference to the structure disclosed, it is not confined to the details set forth; but is intended to cover such modifications, or changes as may come within the scope of the following claims.

What is claimed is:

1. A reproduction printing apparatus of the type employing a continuously moving endless flexible belt having a photoconductive surface adapted to carry an electrostatic latent image of an original to be copied including, a plurality of support rollers having their axes generally in parallel for supporting and guiding the belt in an endless path of movement, said rollers being arranged to effect at least three substantially flat runs of the belt during movement thereof, charging means mounted in operative relationship with a first of said belt runs for uniformly charging the photoconductive belt during movement thereof, said first run lying in a plane at an incline relative to a horizontal plane, imaging means having means for exposing the photoconductive surface during movement thereof to produce an electrostatic latent image of an original to be copied, said imaging means being effective to produce said latent image at an exposure station positioned at a second of said belt runs, said second run lying in a plane substantially parallel to the vertical, developing means mounted below a third of said runs, said developing means comprising a series of individual cooperative developing members for progressively developing the latent image thereat, said third run lying in a plane upwardly inclined to the horizontal plane, means for feeding support material into contact with the belt at one of said support rollers, and transfer means mounted adjacent said one support roller for effecting the transfer of the developed image to the support material as the same is in contact with the belt, said one support roller being positioned vertically higher than the others of said plurality of support rollers and higher than said exposure station and said second run so that the first and third runs are inclined downwardly relative to the horizontal plane running through the axis of said one support roller, said transfer means including a transfer roller disposed in operative relation with said belt opposite said one support roller, said support material passing between said belt and said transfer roller along a transfer path higher than said belt runs.

2. A reproduction printing apparatus of the type employing a continuously moving endless flexible belt having a photoconductive surface adapted to carry an electrostatic latent image of an original to be copied including, three support rollers having their axes generally in parallel for supporting and guiding the belt in an endless path of movement, said rollers being arranged to effect at least three substantially flat operating runs of the belt during movement thereof, means for exposing the photoconductive surface during movement thereof at an exposure station positioned at one of said belt runs oriented in a substantially vertical plane, developing means mounted below a second of said runs, said developing means comprising a series of individual cooperative developing members for progressively developing the latent image thereat, said second run being oriented on an upwardly inclined plane, sheet feed means for feeding sheets seriatim into contact with the belt at one of said support rollers, transfer means mounted adjacent said one roller for effecting the transfer of the developed image to a sheet as the same is in contact with the belt, said one roller being positioned vertically higher than said exposure station, said transfer means including a transfer roller disposed in operative relationship with said belt opposite said one roller, said sheets passing between said belt and said transfer roller along a feed path above said belt runs, and cleaning means mounted adjacent a third run of the belt for removing residual developing material from the belt after each transfer of a developed image from the same, said third run being oriented on an downwardly inclined plane.

* * * * *